US007999689B1

(12) United States Patent
Ray et al.

(10) Patent No.: US 7,999,689 B1
(45) Date of Patent: Aug. 16, 2011

(54) HOUSEHOLD APPLIANCE OPERATION SENSING AND CONTROL HAVING A REMOTELY CONTROLLED AC POWER RECEPTACLE AND AC CURRENT SENSOR

(75) Inventors: D. Allen Ray, Arden, NC (US); Richard W. Bahr, Greenville, WI (US); Scott C. Jaeger, Oshkosh, WI (US); Jonathan M. Rohr, Green Bay, WI (US)

(73) Assignee: SimplyHome, LLC, Asheville, NC (US)

( * ) Notice: Subject to any disclaimer, the term of this patent is extended or adjusted under 35 U.S.C. 154(b) by 454 days.

(21) Appl. No.: 12/261,597

(22) Filed: Oct. 30, 2008

(51) Int. Cl.
*G08B 21/00* (2006.01)

(52) U.S. Cl. ..... 340/664; 340/655; 340/656; 219/445.1

(58) Field of Classification Search ..... 340/654–656, 340/664; 219/445.1, 446.1, 448.11; 361/161–165
See application file for complete search history.

(56) References Cited

U.S. PATENT DOCUMENTS

| | | | |
|---|---|---|---|
| 4,659,909 | A | 4/1987 | Knutson |
| 4,775,913 | A | 10/1988 | Ekblad |
| 5,289,158 | A | 2/1994 | Neves |
| 5,608,378 | A | 3/1997 | McLean et al. |
| 5,717,188 | A | 2/1998 | Vaillancourt |
| 5,854,520 | A | 12/1998 | Buck et al. |
| 5,945,017 | A | 8/1999 | Cheng et al. |
| 6,043,461 | A | 3/2000 | Holling et al. |
| 6,294,994 | B1 | 9/2001 | Hoellerich |
| 6,563,430 | B1 | 5/2003 | Kemink et al. |
| 6,642,852 | B2 | 11/2003 | Dresti et al. |
| 6,860,288 | B2 | 3/2005 | Uhler |
| 7,002,109 | B2 | 2/2006 | Klask |
| 7,110,836 | B2 | 9/2006 | Sturm et al. |
| 2006/0202848 | A1 | 9/2006 | Volodarsky |

OTHER PUBLICATIONS

Phenix Controls Inc., AC Current Sensor Model 9800 datasheet © 2007 ( 2 pages) from the Internet at www.phenixcontrols.com . Apparently dated Mar. 13, 2008. Possible earlier dates unknown.
Interactive Technologies, Inc. datasheet for ITI Part #60-362-10-319.5 "Door/Window Sensor." Effective date unknown.
Interactive Technologies, Inc. installation instructions for 60-362 "Door/Window Sensor," Document No. 466-1022 Rev. C Jun. 1996.
X-10® PRO datasheet for XPR Duplex Receptacle-Receiver. Apparently dated Mar. 2007. Possible earlier dates unknown.
X-10® PRO datasheet for XPFM Fixture Module. Apparently dated Mar. 2007. Possible earlier dates unknown.
Pages from Stove Guard internet website www.stoveguard.com . Effective date unknown.

(Continued)

*Primary Examiner* — Jeffery Hofsass
(74) *Attorney, Agent, or Firm* — Carter & Schnedler, P.A.

(57) ABSTRACT

Device operation sensing and control apparatus for use in combination with a wireless security panel which communicates with a remote operations center, to facilitate independent at-home living of, for example, semi-autonomous elderly persons. One apparatus embodiment includes a remotely controlled AC power receptacle module controllable by signals from the wireless security panel and into which a device such as a microwave oven is plugged. An AC current sensor is connected to an alarm system transmitter for transmitting a signal when the device is in use. Another apparatus embodiment senses operation of and allows remote control of power to an electric range. First and second timers and associated alarm system transmitters transmit a "RANGE ON" signal to the wireless security panel when the electric range is in use, and a "RANGE ON FOR X TIME" signal when the electric range has been use for a predetermined length of time.

7 Claims, 6 Drawing Sheets

OTHER PUBLICATIONS

Alarm.com internet home page www.alarm.com and "How It Works" page www.alarm.com/about. Effective date unknown.

GE Security Products internet webpage for Simon 3 Control Panel 60-875-11-3 http://www.gesecurity.com/portal/site/GESecurity/menuitem.f76d98ccce4cabed5efa421766030730?selectedID=1347&seriesyn=true&seriesID © 1997-2008 General Electric Company. Effective date unknown.

GE Security Simon 3 Control Panel Product Data Sheet (2 pages). Effective date unknown.

GE Security Simon 3 security and overview/datasheet Document 466-1908F-simon-ds (2 pages). Apparently dated Apr. 9, 2007. Possible earlier dates unknown.

Interlogix Simon 3 Brochure (4 pages). © 2002 Interlogix, Inc.

GE Interlogix Simon® Security System User Guide, Part No. 60-875, 466-1871 Rev J, May 2003.

GE Security Products internet webpage for Simon 3 GSM Cellular Module 600-1048 http://www.gesecurity.com/portal/site/GESecurity/menuitem.f76d98ccce4cabed5efa421766030730?selectedID=6914&seriesyn=true © 1997-2008 General Electric Company. Effective date unknown.

GE Simon 3 Cellular Module 600-1048 Data Sheet (2 pages). © 2006 GE Security. Effective date unknown.

GE Security Simon 3 GSM Cellular Module Brochure (4 pages). Apparently dated Jun. 14, 2006. Possible earlier dates unknown.

HOUSEHOLD APPLIANCE OPERATION SENSING AND CONTROL HAVING A REMOTELY CONTROLLED AC POWER RECEPTACLE AND AC CURRENT SENSOR

BACKGROUND OF THE INVENTION

The invention relates generally to home monitoring systems to facilitate independent at-home living of, for example, semi-autonomous elderly persons.

Home monitoring systems are well known, such as those based on a Simon® 3 control panel available from General Electric Company. Such systems, through various available sensor and control modules, allow monitoring of activities in a home, as well as the remote control of lights and other devices. The Simon® 3 control panel includes a radio receiver operating at a frequency of 319.5 MHz to receive signals from sensor modules within the home, and an X10® control transmitter to transmit signals over AC power wiring to various X10® receiver modules within the home. Communication between the wireless security panel and a remote operations center is effected by land-line telephone communication, internet connection, or through a GSM cellular telephone network, as examples. Central monitoring and control services employing a GSM cellular telephone network are available, for example, through alarm.com.

Personnel, or an automated system, at the central monitoring system are able to monitor activities within the home, control devices within the home, and notify third parties in the event an "alert" situation is detected within the home which requires attention. Activity as well as inactivity can be sensed. Thus, monitored status and control activities can be relayed to or from interested parties such as family members of a person or persons living in a monitored home, caregivers in general, and other providers. Messages can be sent by email, text message, and cell phone message.

SUMMARY OF THE INVENTION

In one aspect, device operation sensing and control apparatus is provided for use in combination with a wireless security panel. The apparatus includes an enclosure, and a remotely controlled AC power receptacle module mounted within the enclosure, with receptacles accessible through at least one aperture in the enclosure. The AC power receptacle module is controllable by signals from the wireless security panel. The apparatus includes an AC power plug. Conductors extend from the AC power plug and are connected within the enclosure to the remotely controlled AC power receptacle module. An AC current sensor has an output which is active when sensed current is above a threshold, and is arranged to sense current drawn through the AC power receptacle module An alarm system transmitter is responsive to the output of the AC current sensor and either connected to transmit a signal to the wireless security panel when the AC current sensor output is active, or connected to transmit a signal to the wireless security panel when the AC current sensor output is not active.

In another aspect electric range operation sensing and control apparatus is provided for use in combination with a wireless security panel. The apparatus includes an enclosure, and a range power receptacle mounted within the enclosure and accessible through an aperture in the enclosure. A remotely controlled AC power switch module is mounted within the enclosure. The AC power switch module is controllable by signals from the wireless security panel. A contactor relay within the enclosure is electrically connected so as to be activated by the AC power switch module. The apparatus includes a range power plug. Conductors extend from the range power plug to the contactor relay, and conductors extend from the contactor relay to the range power receptacle so as to energize the range power receptacle when the contactor relay is activated. At least one AC current sensor has an output which is active when sensed current is above a threshold, and is arranged to sense current drawn through the range power receptacle. A first timer has an input connected to the AC current sensor output and has a first timer output which is active when the AC current sensor output is active, and remains active for a first predetermined time duration after the AC current sensor output is no longer active. A first alarm system transmitter is connected to transmit a "RANGE ON" signal to the wireless security panel when the first timer output is active. A second timer has an input connected to the first timer output and has a second timer output which becomes active when the first timer output has been active for a second predetermined time duration. A second alarm system transmitter is connected to transmit a "RANGE ON FOR X TIME" signal to the wireless security panel when the second timer output is active.

DETAILED DESCRIPTION

Figure 1:
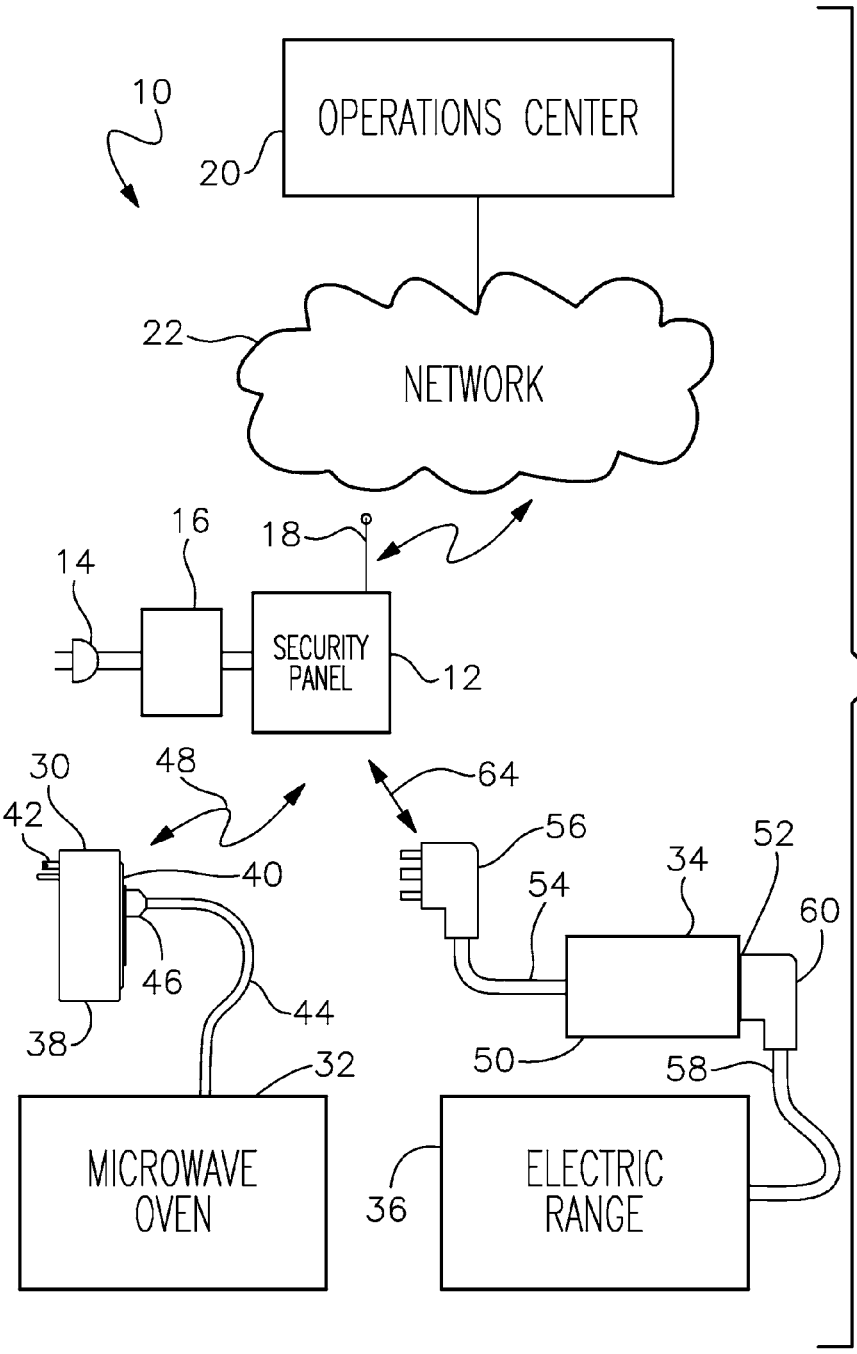
FIG. 1 is an overview of a home monitoring system embodying the invention.

Referring first to FIG. 1, a home monitoring system generally designated 10 includes a wireless security panel 12, such as a Simon® 3 control panel available through General Electric Company. The wireless security panel 12 includes an internal battery backup (not shown), and is powered through a 120 volt AC power plug 14 and a transformer 16. The wireless security panel 12 is microprocessor based (not shown) and includes both a radio receiver (not shown) operating for example at a frequency of 319.5 MHz for receiving signals from various available sensors, and a transmitter (not shown) for transmitting control signals to various X10® receiver modules through the AC power line into which the AC power plug 14 is plugged. As represented by antenna 18, the wireless security panel 12 includes a GSM cellular module for bidirectional communications between the wireless security panel 12 and a remote operations center 20. In FIG. 1, a cellular telephone communications network is represented by cloud 22. Other forms of network communications may as well be employed, such as land-line telephone, and internet. Although embodiments of the invention described in detail herein employ X10® protocol control signals and receiver modules, it will be appreciated that other remote control systems and protocols may be employed, such as INSTEON®.

Also represented in FIG. 1 are two embodiments of the invention. The first is a device operation sensing and control apparatus 30 connected, for example, to a controlled device 32 in the representative form of a microwave oven 32. The second is an electric range operation sensing and control apparatus 34, connected to an electric range 36. The device operation sensing and control apparatus 30 is described in greater detail hereinbelow with reference to FIGS. 2-5. The electric range operation sensing and control apparatus 34 is described in greater detail hereinbelow with reference to FIGS. 6 and 7.

Still with reference to FIG. 1, the device operation sensing and control apparatus 30 includes an enclosure 38 in which are mounted a 120 volt AC power receptacle 40 and an AC power plug 42 which is plugged into a 120 volt household AC power receptacle (not shown). The microwave oven 32 includes a power cord 44 terminating in a 120 volt AC power plug 46 which is plugged into the receptacle 40 of the device operation sensing and control apparatus 30 embodying the invention. In the absence of the subject invention, the microwave oven 32 AC power plug 46 is plugged directly into the household AC power receptacle (not shown). As represented by signal transmission arrow 48, the device operation sensing and control apparatus 30 transmits sensor signals to the wireless security panel 12, and receives control signals from the wireless security panel 12.

The electric range operation sensing and control apparatus 34 likewise includes an enclosure 50 in which is mounted a 240 volt AC range power receptacle 52. Extending from the enclosure 50 is a power cord 54 terminating in a power plug 56 which is plugged into a 240 volt household range power receptacle (not shown). The electric range 36 includes a 240 volt AC power cord 46 terminating in a range power plug 58 which is plugged into the receptacle 52 of the electric range operation sensing and control apparatus 34. In the absence of the subject invention, the range power plug 62 is plugged directly into the household range power receptacle (not shown). As represented by signal transmission arrow 64, the electric range operation sensing and control apparatus 34 transmits sensor signals to the wireless security panel 12, and receives control signals from the wireless security panel 12.

Figure 2:
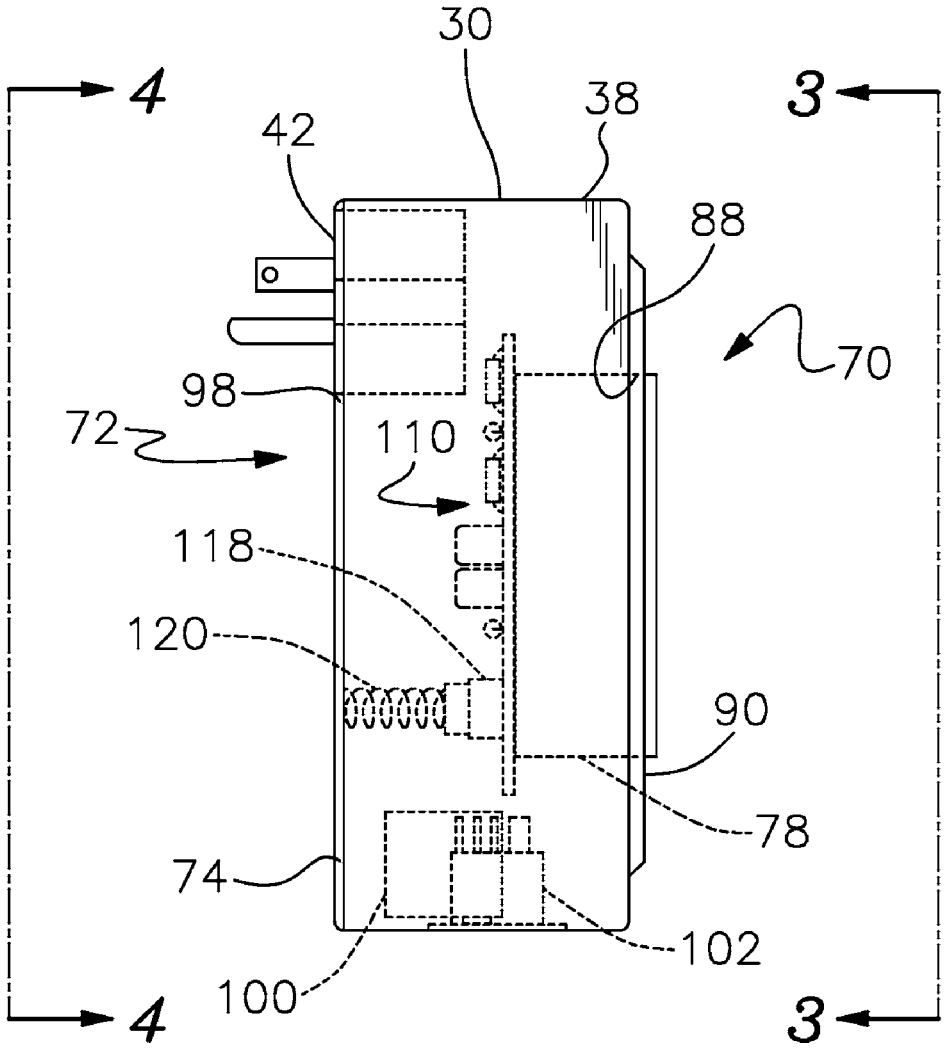
FIG. 2 is a side elevational view of a device operation sensing and control apparatus embodying invention.
Figure 3:
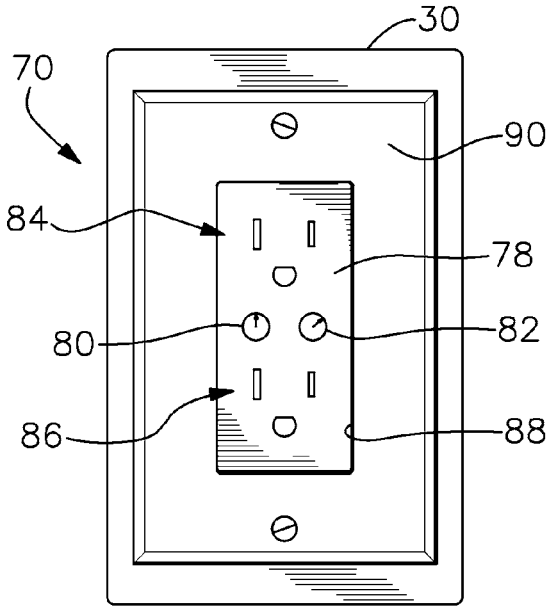
FIG. 3 is a front view of the apparatus of FIG. 2, taken on line 3-3 of FIG. 2.
Figure 4:
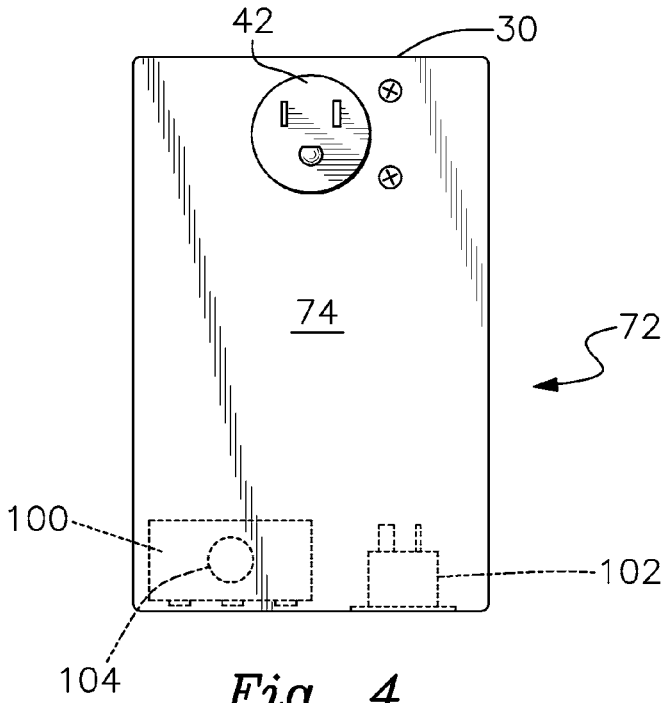
FIG. 4 is a rear view of the apparatus of FIG. 2, taken on line 4-4 of FIG. 2.
Figure 5:
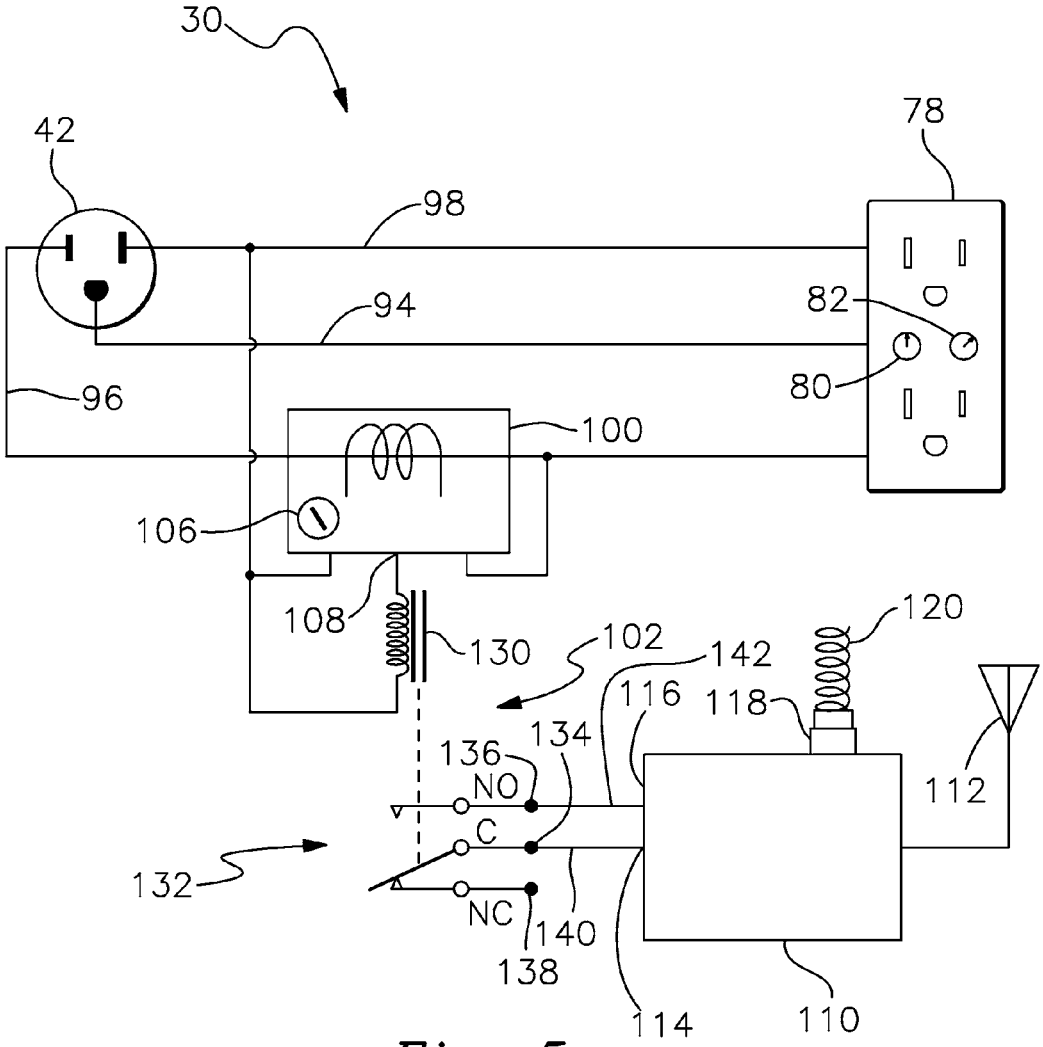
FIG. 5 is an electrical schematic diagram of circuitry within the apparatus of FIGS. 2-4.

Considering the first embodiment of the invention in greater detail, FIGS. 2-4 show one possible physical arrangement of electrical components within the enclosure 38 of the device operation sensing and control apparatus 30 of FIG. 1. The enclosure 38 has front and rear sides 70 and 72 (FIGS. 3 and 4, respectively), and includes a removable rear panel or cover 74. FIG. 5 is a corresponding electrical schematic diagram.

Mounted within the enclosure 38 is a remotely controlled AC power receptacle module 78, corresponding to the FIG. 1 receptacle 40, and mounted at the front side 70 of the enclosure 38. In the illustrated embodiment, the AC power receptacle module 78 is a model No. XPR duplex receptacle-receiver which responds to X10® ON/OFF commands, available through X10® Pro of Tampa, Fla. To set the X10® control address, the module 78 includes a "House Code" switch 80 and a "Unit Number" switch 82. Thus, the AC power receptacle module is ON/OFF controllable by X10® signals from the FIG. 1 wireless security panel 12, which signals are carried by AC power wiring within the house. The module 78 more particularly includes a pair of AC receptacles 84 and 86 accessible through an aperture 88 in the enclosure 38. A decorative faceplate 90 surrounds the receptacles 84 and 86.

It is relevant to note that a characteristic of the model No. XPR duplex receptacle-receiver module 78 employed is that, in the event of an AC power failure and restoration, the output maintains its previous state. Thus, if the module 78 is "ON" when power is lost, upon subsequent restoration of power the module 78 is "ON" and the receptacle 40 has power. Upon system initiation, a signal is sent to the XPR duplex receptacle-receiver module 78 to ensure it is "ON", which then is the normal condition until a signal is sent through the security panel 12 to turn OFF power to the controlled device 32.

Mounted to the rear cover 74 and projecting through an aperture 94 at the rear side 72 of the enclosure 38 is the AC power plug 42. In the illustrated embodiment, the AC power plug 42 is a Pass & Seymour model No. PS5266SSAN right-angle plug. As shown in FIG. 5, ground 94, line (L) 96 and neutral (N) 98 conductors extend within the enclosure 38 from the AC power plug 42 to the remotely controlled AC power receptacle module 70.

Also mounted within the enclosure 38 is an AC current sensor 100 and an associated relay 102. In the illustrated embodiment the current sensor 100 is an AC current sensor available from Phenix Controls Inc., as model No. 9800A4. The Phenix model No. 9800A4 is similar to a Phenix model No. 9800A3, with a 120 VAC operating voltage and a relay output, and has a 20 ampere sensing range. In order to sense current drawn through the AC power receptacle module 70, the L conductor 96 passes through an aperture 104 in the current sensor 100.

The AC current sensor 100 has an output 108 which is active when sensed current is above a threshold, indicating the plugged-in device such as the microwave oven 32 is in use. The current threshold is adjusted by means of a current threshold adjustment 106.

Also within the enclosure 38 is an alarm system transmitter 110, responsive to the output 108 of the AC current sensor 100. The alarm system transmitter 110 includes an antenna 112 for transmitting a radio signal, for example at a frequency of 319.5 MHz, to the wireless security panel 12. The alarm system transmitter 110 may be an ITI part No. 60-362-10-319.5 door/window "sensor", available from Interactive Technologies, Inc. Although including magnetic reed switches and intended to be employed in conjunction with a door or window magnet, the ITI part No. 60-362-10-319.5 "sensor" includes "external" switch terminals 114 and 116 for connection of external switches. (The reed switches are removed when the "external" switch terminals 114 and 116 are employed.) The transmitter 110 includes an internal battery, with a typical battery life of five to eight years. The alarm system transmitter 110 also includes a tamper switch 118 having an actuator 120, the intended use of which is to cause a "tamper" signal to be transmitted to the security panel 12 when the cover (not shown) of the transmitter 110 is removed, indicating that someone has the possible intention to remove the transmitter from the wall.

In embodiments of the subject invention, the tamper switch 118 and actuator 120 are employed to provide a "tamper" warning when the rear cover 74 of the enclosure 38 is removed. Thus, as shown in FIG. 2, the supplied rear cover (not shown) of the ITI part No. 60-362-10-319.5 door/window "sensor" is removed and discarded. The actuator 120 of the tamper switch 118 is positioned so as to be depressed when the rear cover 74 of the enclosure 38 is in place, and released when the rear cover 74 is removed, thus actuating the tamper warning.

The alarm system transmitter 110 is either connected to transmit a signal to the wireless security panel 12 when the AC current sensor output 108 is active, or connected to transmit a signal to the wireless security panel 12 when the AC current sensor output 108 is not active, depending on the particular application.

More particularly, the relay 102 associated with the current sensor 100 includes a coil 130 and a contact set 132 connected to a common (C) contact terminal 134, a normally open (NO) contact terminal 136, and a normally closed (NC) contact terminal 138. A pair of wires 140 and 142 is connected to the "external" switch terminals 114 and 116 of the alarm system transmitter 110. The wire 140 is connected to the common (C) contact terminal 134. Depending on the particular application, that is on the nature of the device to be monitored and controlled (in the illustrated embodiment the microwave oven 32), the wire 142 is selectively connected to either the NO contact terminal 136 or the NC contact terminal 138 of the relay 102.

During operation, the apparatus 30 employs current sensing to recognize when a power consuming device, such as the representative microwave oven 32, is plugged into the apparatus 30, and is consuming operational power. Some devices have auxiliary items (e.g. control circuitry or digital clocks) which consume power even when the primary function of the device is off. These auxiliary items generally consume less than 0.5 ampere. In order to recognize when the plug-in device is operating for its primary function, the current sensor 100 is adjusted so that the relatively lower current when the primary function is not "on" is below the current threshold. Any level of current above the threshold triggers an indication that the device is operating.

It will be appreciated that the device operation sensing and control apparatus 30 embodying the invention thus provides a simple, effective and self-contained apparatus which conveniently enables both remote sensing of the operation of a device such as the microwave oven 32 and remote control thereof through the wireless security panel 12 and the operations center 20, employing standard wireless security panel 12 features. The single apparatus 30 provides a transmitted signal indicating whether the controlled device 32 is either in use or not, and also receives "ON" and "OFF" control signals. From the point of view of the wireless security panel 12, the transmitted signal is a simple sensor input. The wireless security panel 12 does not have to be concerned with threshold current sensing. For device 32 control purposes, from the point of view of the wireless security panel, the apparatus 30 is the same as any other X10® controlled device. When desired, based on the transmitted signal, depending upon the particular monitoring functions to be provided, the controlled device 32 can remotely be turned "OFF" by transmitting an "OFF" signal through the wireless security panel 12.

Figure 6:
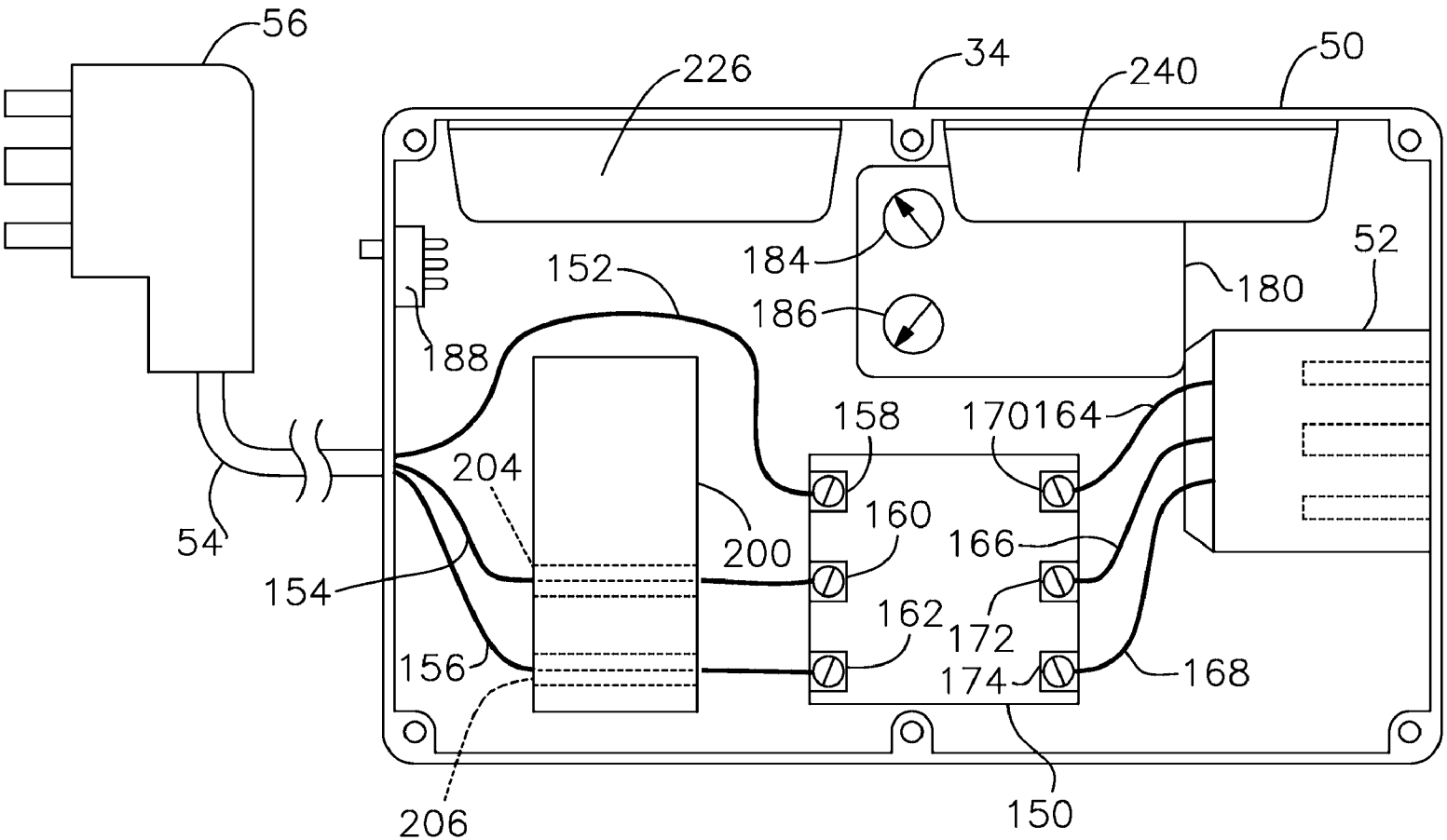
FIG. 6 is a view of electric range operation sensing and control apparatus embodying the invention, generally depicting an exemplary mechanical arrangement of electrical components within an enclosure.
Figure 7:
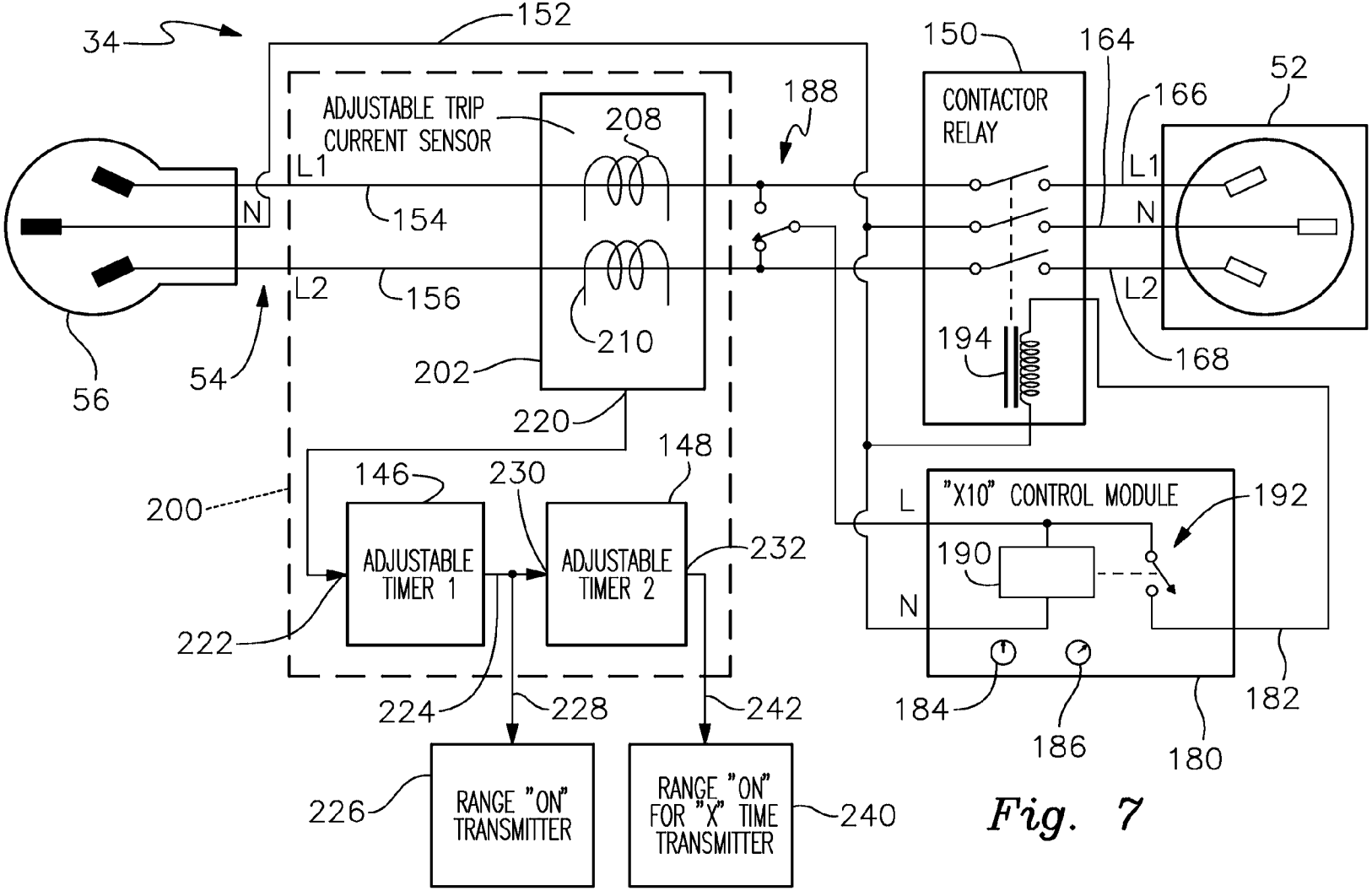
FIG. 7 is an electrical schematic diagram of the electric range operation sensing and control apparatus of FIG. 6.

With reference now to FIGS. 6 and 7, the FIG. 1 electric range operation sensing and control apparatus 34, as the second embodiment of the invention, will now be described in greater detail. FIG. 6 shows one possible physical arrangement of electrical components within the enclosure 50 of the electric range operation sensing and control apparatus 34, and FIG. 7 is a corresponding electrical schematic diagram. To avoid clutter, only conductors conveying power to the electric range 36 are shown in FIG. 6; various other electrical connections among the components are omitted from FIG. 6, but are shown in FIG. 7.

In overview, the electric range operation sensing and control apparatus 34 provides three functions.

The first function is to provide an output signal when the electric range 36 is "ON," transmitting a "Range ON" signal to the wireless security panel 12. In the context of a home monitoring system, inverse terminology may be employed. Thus, the apparatus 34 may be viewed as transmitting an "OK" signal normally, and stopping the transmission of the "OK" signal when the electric range 36 is turned ON. As is well known, range heating elements (not shown) cycle ON and OFF during operation. Heating elements within an oven typically cycle on and off under thermostatic control to maintain a thermostatically-set temperature. Cooktop heating elements generally cycle ON and OFF at a faster rate, with a duty cycle determined by a heat control knob. In order to obtain an apparent "ON" signal for a predetermined amount of time, even when a heating element is cycled off, a first timer 146 is employed, such that a "Range ON" signal (or its equivalent, an inverse "NOT OK" signal) is transmitted even during those periods when a range heating element has cycled off. As one example, a 20-minute timer may be employed. Employing such a timer is actually an accurate reflection of the state of a range, since cooktop heating elements do not cool instantly, and an oven requires time to cool after being turned off.

The second function of the apparatus 34 is to provide a "Range ON for X Time" signal to the wireless security panel 12 when the range 36 has been turned on for more than a set period of time, for example, two hours. Alternatively, the functionality may be viewed as an inverse function, that is, stopping the transmission of an "OK" signal when the range has been on for more than the predetermined amount of time. A second timer 148 is employed for this purpose, the input of which is connected to the output of the first timer 146.

The third function is to provide the capability of remotely shutting off power to the electric range 36 when a decision to do so has been made based on the "Range ON" and "Range ON for X Time" signals, as processed through the wireless security panel 12 and received at the FIG. 1 operations center 20.

As illustrated in FIG. 6, the AC power receptacle 52 is mounted within the enclosure 50, and the power cord 54 terminating in the power plug 56 extends from the enclosure 50. Although three-wire range power connections are shown, a four-wire range power receptacle and plug may as well be employed (not shown).

For controlling power to the electric range 36, a contactor relay 150 is electrically connected in series between the power plug 56 and the receptacle 52. The contactor relay 150 may be a 50 ampere contactor, such as an Allen Bradley No. 400DP50ND3. From the power cord 54 neutral (N) 152, line 1 (L1) 154 and line 2 (L2) 156 conductors are connected to respective terminals 158, 160 and 162 of the contactor relay 150. Corresponding neutral (N) 164, line 1 (L1) 166 and line 2 (L2) 168 conductors extend from respective terminals 170, 172 and 174 of the contactor relay 150 to the receptacle 52.

To actually control energization of the receptacle 52 and thus the electric range 36 via the contactor relay 150, a remotely controlled AC power switch module 180 is mounted within the enclosure 50, and is controllable by signals from the wireless security panel 12. In the illustrated embodiment, the remotely controlled AC power switch module 180 is a model XPFM fixture module which includes a receiver that responds to X10® ON/OFF commands. The model XPFM fixture module is available through X10® Pro of Tampa, Fla. The XPFM module includes neutral (N) and "hot" or line (L) leads for connection to a 120 VAC supply, and an output lead 182. To set the X10® control address, the module 180 includes a "House Code" switch 184 and a "Unit Number" switch 186. Thus, the module 180 is controllable by X10® signals from the FIG. 1 wireless security panel 12, carried by AC power wiring within the home. Homes are generally wired split-phase; each 120 volt phase is not directly connected with the other 120 volt phase. For reliable transmission of X10® control signals, it is best that X10® receivers be on the same phase as the X10® transmitter. (Alternatively, an X10® phase coupler may be employed.) In the embodiment of FIGS. 6 and 7, a phase selector switch 188 is provided to select either the L1 or L2 conductor for connection to the "L" lead of the module 180. Thus, 120 VAC is supplied to the module 180 of whichever phase provides the most reliable operation. The neutral or "N" lead of the module 180 is connected to the N conductor. Circuitry within the off-the-shelf remotely controlled module 180 is represented by receiver circuitry 190 and output switch contacts 192, which may be part of a relay (not shown), or a solid state switching device. Thus, the output lead 182 is energized through the module 180 when activated. The output lead 182 is connected to energize a coil 194 of the contactor relay 150.

It is relevant to note that a characteristic of the model No. XPFM fixture module employed as the remotely controlled AC power switch module 180 is that, in the event of an AC power failure and restoration, the output switch 192 maintains its previous state. Thus, if the module 180 is switched "ON" when power is lost; upon subsequent restoration of power the module 180 is "ON." Upon system initiation, a signal is sent to the remotely controlled module 180 directing the contactor relay 150 to be energized, which then is the normal condition until a signal is sent through the security panel 12 to turn OFF power to the electric range 36.

Also mounted within the enclosure 50 is a sensor and timer module 200 which integrates current sensing and timing functions. The module may be a model No. 9634 from Phenix Controls, Inc. The module 200 includes an adjustable-threshold current sensor 202 capable of separately sensing the current through two conductors. Thus, in FIG. 6 two current sensor apertures 204 and 206 are provided through which the L1 and L2 conductors 154 and 156 pass, and two corresponding sensing coils 208 and 210 are represented in the schematic diagram of FIG. 7. In addition, the module 200 includes the first and second timers 146 and 148, which are adjustable. In order to set the current threshold and the time durations of the two timers 146 and 148, the operation of the timers 146 and 148 is described hereinbelow. The particular sensor and timer module 200 employed in the illustrated embodiment is remotely programmable employing a personal computer (PC) and a programming device (not shown) also available from Phenix Controls, Inc. Although a particular sensor and timer module 200 is illustrated, it will be appreciated that the functionality thereof may be readily implemented in a number of ways.

Within the sensor and timer module 200, the current sensor 202 has a functional output 220 which is active when sensed current is above the threshold. The threshold is adjusted such that relatively low standby current drawn by the electric range 36 (and of the module 180 and contactor relay coil 194) is below the threshold, but operation of an actual heating element causes the electric range 36 to draw current above the threshold. Because different electric ranges have different auxiliary devices (e.g., clocks and control circuitry) which draw standby current, the adjustable threshold provides important functionality by facilitating customized set up. Moreover, in the case of a convection oven, a fan (not shown) draws current which can be significant compared to the current drawn by an electric clock. Depending on the particular application, it may be desired to consider the range to either be in use (ON) or not in use (still OFF) when only the convection oven fan is operating. The adjustable current threshold allows this choice to be made during set up.

The first timer 146 has an input 222 connected to the current sensor 202 output 220. The first timer 146 has an output 224 which is active when the current sensor 202 output 220 is active, and which remains active for a first predetermined time duration, for example twenty minutes, even after the output 220 of the AC current sensor 202 is no longer active.

For transmitting a "Range ON" signal to the wireless security panel 12, a first alarm system transmitter 226 is provided and functionally connected to the output 224 of the first timer 146. An ITI part No. 60-362-10-319.5 door/window "sensor" transmitter may be employed for this purpose, essentially identical to the alarm system transmitter 110 described hereinabove with reference to the first embodiment of FIGS. 2-5. In FIG. 7, a logical connection 228 only is indicated, rather than two wires (not shown) in the actual physical embodiment.

The second timer 148 has an input 230 connected to the output 224 of the first timer 146, and a second timer output 232 which becomes active when the first timer output 224 has been active for a second predetermined time duration, such as two hours. To transmit a "Range ON for X Time" signal to the wireless security panel 12 when the second timer output 232 is active, a second alarm system transmitter 240 is provided, which likewise may be an ITI part No. 60-362-10-319.5 door/window "sensor" employing auxiliary switch terminals, rather than the internal reed switches. Connection of a second timer output 232 to the second alarm system transmitter 240 is represented by logical connection 242.

It will be appreciated that the electric range operation sensing and control apparatus 34 embodying the invention thus provides a simple, effective and self-contained apparatus which conveniently enables both remote sensing of the operation of the electric range 36 and remote control thereof through the wireless security panel 12 and the operations center 20, employing standard wireless security panel 12 features. The single apparatus 34 provides separate "Range ON" and "Range ON for X Time" transmitted signals to indicate whether the range is in use, and receives control signals as well. From the point of view of the wireless security panel 12, the transmitted signals are simple sensor inputs. The wireless security panel 12 does not have to be concerned with details of current thresholds or of timer functions. For range control purposes, from the point of view of the wireless security panel 12, the apparatus 34 is the same as any other X10® controlled device.

When desired, based on the "Range ON" and "Range ON for X Time" signals, depending upon the particular monitoring functions to be provided, the electric range 36 can remotely be turned "OFF" by transmitting an "OFF" signal through the remotely controlled X10® AC power switch module 180, de-energizing the contactor relay.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. Device operation sensing and control apparatus for use in combination with a wireless security panel, said apparatus comprising:

an enclosure;

a remotely controlled AC power receptacle module mounted within said enclosure, with receptacles accessible through at least one aperture in said enclosure, said AC power receptacle module controllable by signals from the wireless security panel;

an AC power plug;

conductors extending from said AC power plug and connected within said enclosure to said remotely controlled AC power receptacle module;

an AC current sensor having an output which is active when sensed current is above a threshold, said AC current sensor arranged to sense current drawn through said AC power receptacle module; and an alarm system transmitter responsive to said output of said AC current sensor and either connected to transmit a signal to the wireless security panel when said AC current sensor output is active, or connected to transmit a signal to the wireless security panel when said AC current sensor output is not active.

2. The apparatus of claim 1, wherein said AC current sensor has an adjustable threshold.

3. The apparatus of claim 1, wherein:

said enclosure includes a removable cover; and wherein said alarm system transmitter includes a tamper switch having an actuator positioned so as to activate said tamper switch when said cover is removed, said alarm system transmitter operable to transmit a signal to the wireless security panel when said tamper switch is activated.

4. Electric range operation sensing and control apparatus for use in combination with a wireless security panel, said apparatus comprising:

an enclosure;

a range power receptacle mounted within said enclosure and accessible through an aperture in said enclosure;

a remotely controlled AC power switch module mounted within said enclosure, said AC power switch module controllable by signals from the wireless security panel;

a contactor relay within said enclosure electrically connected so as to be activated by said AC power switch module;

a range power plug;

conductors extending from said range power plug to said contactor relay, and conductors extending from said contactor relay to said range power receptacle so as to energize said range power receptacle when said contactor relay is activated;

at least one AC current sensor having an output which is active when sensed current is above a threshold, said at least one AC current sensor arranged to sense current drawn through said range power receptacle;

a first timer having an input connected to said AC current sensor output and having a first timer output which is active when said AC current sensor output is active, and remains active for a first predetermined time duration after said AC current sensor output is no longer active;

a first alarm system transmitter connected to transmit a "RANGE ON" signal to the wireless security panel when said first timer output is active;

a second timer having an input connected to said first timer output and having a second timer output which becomes active when said first timer output has been active for a second predetermined time duration; and a second alarm system transmitter connected to transmit a "RANGE ON FOR X TIME" signal to the wireless security panel when said second timer output is active.

5. The apparatus of claim 4, wherein said at least one AC current sensor has an adjustable threshold.

6. The apparatus of claim 4, wherein the first predetermined time duration is adjustable.

7. The apparatus of claim 4, wherein the second predetermined time duration is adjustable.

* * * * *